US006559623B1

(12) United States Patent
Pardoen

(10) Patent No.: US 6,559,623 B1
(45) Date of Patent: May 6, 2003

(54) IN-RUSH CURRENT CONTROL FOR A LOW DROP-OUT VOLTAGE REGULATOR

(75) Inventor: Matthijs D. Pardoen, Sunnyvale, CA (US)

(73) Assignee: Integration Associates Inc., Mountain View, CA (US)

( * ) Notice: Subject to any disclaimer, the term of this patent is extended or adjusted under 35 U.S.C. 154(b) by 0 days.

(21) Appl. No.: 10/161,201

(22) Filed: Jun. 3, 2002

Related U.S. Application Data

(60) Provisional application No. 60/295,069, filed on Jun. 1, 2002.

(51) Int. Cl.[7] ..... G05F 1/618; G05F 1/44

(52) U.S. Cl. ..... 323/274; 323/273; 323/908

(58) Field of Search ..... 323/273, 274, 323/908, 901, 276, 275

(56) References Cited

U.S. PATENT DOCUMENTS 6,188,210 B1 * 2/2001 Tichauer et al. ..... 323/273

6,275,395 B1 * 8/2001 Inn et al. ..... 363/60

* cited by examiner

*Primary Examiner*—Bao Q. Vu

(74) *Attorney, Agent, or Firm*—Vernon W. Francissen; Gardner Carton & Douglas LLC

(57) ABSTRACT

A method and circuit are shown for controlling an in-rush current to a voltage regulator circuit. A sense transistor is coupled in parallel with a pass transistor of the voltage regulator circuit and used to monitor the current through the pass transistor. A sense current through the sense transistor is converted to a voltage signal and input to an amplifier along with a ramping voltage signal generated in response to a circuit activation signal. An output of the amplifier drives a control gate of a current source that sources current to gate terminals of both the pass transistor and the sense transistor. A limiting circuit also monitors the sense current and sinks current from the control terminal of the current source in order to limit a maximum current through the pass transistor.

17 Claims, 4 Drawing Sheets

IN-RUSH CURRENT CONTROL FOR A LOW DROP-OUT VOLTAGE REGULATOR

CROSS-REFERENCE TO RELATED APPLICATIONS

This application claims the benefit of U.S. provisional patent application No. 60/295,069 filed Jun. 1, 2001, herein incorporated by reference in its entirety.

FIELD OF THE INVENTION

The present invention relates voltage regulators and, more particularly, to the control of an in-rush current into a voltage regulator circuit.

BACKGROUND OF THE INVENTION

Low drop-out regulators provide a minimum voltage drop between an input terminal and an output terminal while maintaining good regulation characteristics.

FIG. 1 is a circuit diagram illustrating an example of a low drop-out voltage regulator 10. An input voltage $V_{IN}$ is supplied to an input terminal 12 of the voltage regulator 10, where an input capacitor 13 having input capacitance $C_{IN}$ is provided at input terminal 12 in order to reduce the effects of a start-up surge current. Voltage regulator 10 produces an output voltage $V_{OUT}$ at an output terminal 14 by passing current from input terminal 12 to output terminal 14 through a pass transistor 40. An error amplifier 26 receives the output voltage $V_{OUT}$ through a divider network composed of resistors 44 and 46 and compares it to a reference voltage Vref from a reference voltage source 22. A control signal is produced at the output of error amplifier 20 that is coupled to input terminal 12 via resistor 34 in series with capacitor 36 and through capacitor 32, which form a compensation network for stability of the regulator 10. The control signal is then buffered by amplifier/driver 30 and the buffered signal drives the gate of pass transistor 40.

In regulator 10, pass transistor 40 is a PMOS (P-channel Metal Oxide Semiconductor) device and is typically a large-area power transistor configured to handle relatively large amplitude current. Typically, the pass transistor 40, as a MOS transistor, does not have a saturation voltage as is known with respect to bipolar transistors. Also, no base current is applied to the gate of pass transistor 40. There is a trend in current designs for voltage regulators to minimize the input to output voltage drop experienced from input terminal 12 to output terminal 14 and to maximize the current capability of the regulator. For example, with current designs, a drop-out voltage of 100 mV for a output current of 150 mA is typical.

Furthermore, an output capacitance ($C_{out}$), e.g. in the form of output capacitor 48, is typically required to provide for amplifier stability for a low drop-out voltage regulator. The output capacitor also improves the Power Supply Rejection Ratio (PSRR) characteristic for high frequencies above the amplifier's bandwidth.

There is also a trend in current designs to reduce the regulator's start-up time, e.g. the time required for the voltage regulator to achieve its steady operating state. Reduction of start-up time is typically achieved by allowing the MOS pass transistor 40 to deliver a large start-up current (or surge current) when the circuit is first enabled or switched on. The current required to obtain a start-up time of Δt seconds is described by the following equation:

$$I = C_{out}\left(\frac{V_{out}(nominal)}{\Delta t}\right)$$

In this equation, the current I is expressed in terms of the output capacitance $C_{out}$ of capacitor 48 multiplied by the nominal output voltage at terminal 14 divided by the start-up time Δt. It is not uncommon to see a low drop-out voltage regulator designed to operate at 150 mA have a start-up or surge current on the order of 700 mA.

Although the start-up time for the voltage regulator may be reduced by increasing the start-up current, the high series resistance that is typical of batteries will result in a significant voltage drop in $V_{IN}$ at input terminal 12 when the high surge currents occur at start-up. Furthermore, these high voltage spikes at input terminal 12 can cause faulty circuit behavior. For example, a 3 V/10 mA battery application with a 700 mA start-up current can easily cause a 1.5 V voltage drop, depending upon on the capacitance $C_{IN}$ of the input capacitor 13. It is also common to observe oscillations at start-up due to the surge currents present at input terminal 12 if $V_{IN}$ drops below $V_{OUT}$ due to the effect of the surge current and the series resistance of a battery supply.

SUMMARY OF THE INVENTION

An embodiment of a control circuit for controlling an in-rush current of a voltage regulator circuit having a pass transistor, where the pass transistor has a control terminal, a first current terminal that is coupled to an input terminal of the regulator circuit, and a second current terminal coupled to an output terminal of the regulator circuit, where the control circuit includes a sense transistor having first and second current terminals and a control terminal, and where the first current terminal of the sense transistor is coupled to the input terminal of the regulator circuit and the control terminal of the sense transistor is coupled to the control terminal of the pass transistor. A ramp voltage generator circuit is provided for generating a ramp voltage signal responsive to a control signal received at an input terminal of the ramp voltage generator circuit. The control circuit includes a first current source having first and second current terminals and a control terminal, the first current terminal of the first current source being coupled to the input terminal of the voltage regulator circuit and the second current terminal of the first current source being coupled to the control terminal of the pass transistor. The control circuit also includes an amplifier having first and second input terminals and an output terminal, where the first input terminal of the amplifier is configured to receive a first voltage signal derived from the sense current, the second input terminal of the amplifier is configured to receive the ramp voltage signal, and the output terminal of the amplifier being coupled to the control terminal of the first current source. In a further refinement of this embodiment the first current source further comprises a current mirror circuit configured to operate from a low power supply voltage. In still another refinement of this embodiment, the control circuit further includes a limiting circuit having first and second current terminals, first and second input terminals, and an output terminal, the first current terminal of the limiting circuit being coupled to the control terminal of the current source, the second current terminal of the limiting circuit being coupled to the power supply terminal, the first input terminal of the limiting circuit being configured to receive a second voltage signal derived from the sense current, the second input terminal of the limiting circuit being configured to receive a predetermined threshold voltage, and the output terminal of the limiting circuit being coupled to the control terminal of the first current source, where the limiting circuit is configured to compare the second voltage signal derived from the sense current to the predetermined threshold voltage and generate a current limiting signal at the output terminal of the limiting circuit.

An embodiment of a method, according to the present invention, for controlling an in-rush current through a pass transistor of a voltage regulator circuit, calls for providing a sense transistor that mirrors the pass transistor, converting a sense current of the sense transistor into a first voltage signal, and generating a ramp voltage signal responsive to a control signal. The method then calls for comparing the first voltage signal to the ramp voltage signal to generate an in-rush current control signal and sourcing current to control terminals of the sense transistor and the pass transistor under control of the in-rush current control signal. In a further refinement of this embodiment of the present invention, the step of converting a sense current of the sense transistor into a first voltage signal includes converting the sense current of the sense transistor into a second voltage signal. This further refinement then calls for limiting the in-rush current control signal when the second voltage signal reaches a predetermined threshold.

BRIEF DESCRIPTION OF THE DRAWINGS

The present invention is described with reference to the following drawings, where like reference numbers indicate like elements.

DETAILED DESCRIPTION OF THE PRESENT INVENTION

It is the purpose of the present invention to include a start-up current control circuit on the regulator chip that allows a maximum start-up current, but which does not go significantly above the maximum current required for a given application. The present invention performs all this independently of the current capability of the regulator.

Figure 1:
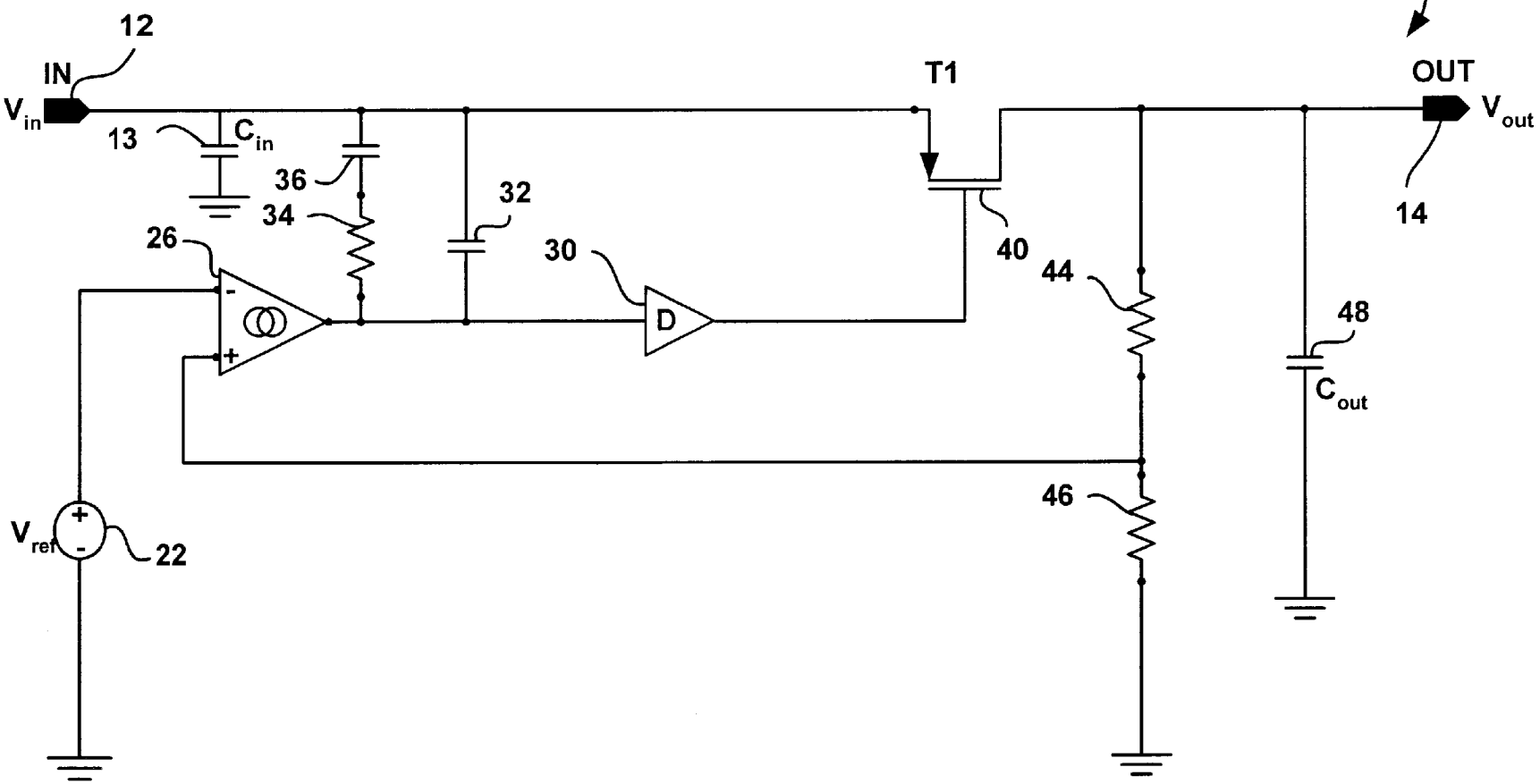
FIG. 1 is a circuit diagram illustrating an example of a low drop-out voltage regulator circuit suitable for application of the present invention.
Figure 2:
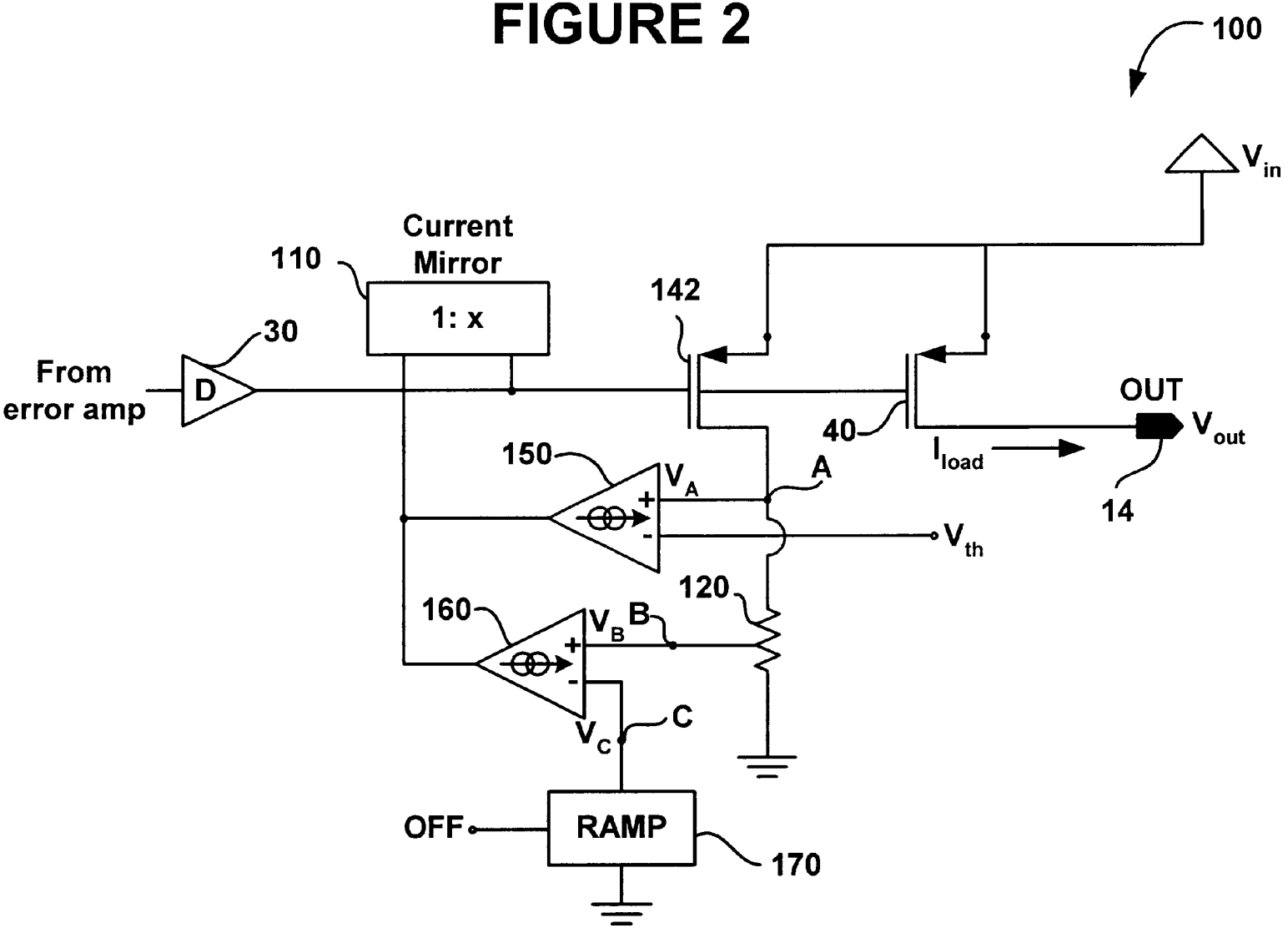
FIG. 2 is a functional block diagram illustrating an embodiment of the present invention for controlling an in-rush current of the voltage regulator circuit of FIG. 1.

FIG. 2 is a functional block diagram illustrating an embodiment of a current control circuit 100, according to the present invention, for controlling an in-rush current to a voltage regulator, such as the voltage regulator circuit of FIG. 1. In the present invention, a sense transistor 142 is provided that has its control terminal, e.g. gate terminal, coupled to a control terminal of the pass transistor 40 of the voltage regulator circuit of FIG. 1. Amplifier/driver 30 of the voltage regulator circuit drives the gates of both the pass transistor 40 and the sense transistor 142. Consequently, the sense current through sense transistor 142 is proportional to the output current in pass transistor 40. Sense transistor 142 is typically a much smaller device than pass transistor 40 so that the sense current drawn by sense transistor 142 is substantially smaller in magnitude than the output current, e.g. $I_{LOAD}$, drawn by pass transistor 40. Both the pass transistor 40 and the sense transistor 142 typically draw current from the input voltage $V_{IN}$ present at input terminal 12 of voltage regulator 10.

Control circuit 100 includes a current mirror 110 that operates as a current source that sources current from a power supply rail, which may be input voltage $V_{IN}$, to the gate of sense transistor 142. In this embodiment, amplifier/driver 30 is device with weak current sinking capacity such that current mirror 110 can override the signal provided by amplifier/driver 30. Current mirror 110 is selected as the current source in this embodiment because it will allow the circuit to operate at low supply voltage levels, e.g. low $V_{IN}$.

Sense transistor 142 sources the sense current to a circuit node A, which is coupled to a divider circuit 120 and a limit circuit 150. In this embodiment, divider circuit 120 is used to convert the sense current through sense transistor 142 into two voltage signals $V_A$ and $V_B$ derived from the sense current using a single current leg. Note, however, that a separate current leg using another transistor coupled in a manner similar to sense transistor 142 could be used to provide one of the voltage signals. In the embodiment shown, divider circuit 120 divides the voltage $V_A$ present at circuit node A to generate voltage $V_B$ at circuit node B.

A ramped voltage signal $C_C$ is generated by ramp circuit 170 at circuit node C responsive to an OFF control signal that may be produced by an external controller, such as a microprocessor, or derived from $V_{IN}$. Note that the ramped voltage signal $C_C$ is independent of the input voltage $V_{IN}$ or the output voltage $V_{OUT}$ and provides a consistent rising voltage level. Voltage $V_B$ is input to an amplifier 160, which compares voltage $V_B$ to the ramped voltage signal $C_C$ at circuit node C in order to generate an in-rush current control signal at the output of the amplifier. Note that, in this embodiment, amplifier 160 sinks current at its output when voltage $V_B$ at its positive input terminal is greater than voltage $C_C$ at its negative input terminal. The in-rush current control signal output from amplifier 160 drives a control terminal of current mirror 110, which sources current to the gates of both pass transistor 40 and sense transistor 142 and changes the voltage level at the gates.

This embodiment of a control circuit according to the present invention includes a limiting circuit 150. A control terminal of limiting amplifier 150 is coupled to circuit node A. Responsive to voltage signal $V_A$ at circuit node A reaching a predetermined threshold $V_{TH}$, limiting circuit 150 sinks current from the control terminal of current source 110 to another power supply rail terminal in order to generate a current limiting signal that limits the in-rush current control signal input to the control terminal of current mirror 110. The threshold voltage $V_{TH}$ may be the threshold voltage of a transistor, as will be seen below with regard to the embodiment of FIG. 3. Limiting circuit 150 effectively monitors the sense current through sense transistor 142 in order to limit the maximum current passing through pass transistor 40 to a maximum current $I_{LIMIT}$.

Figure 3:
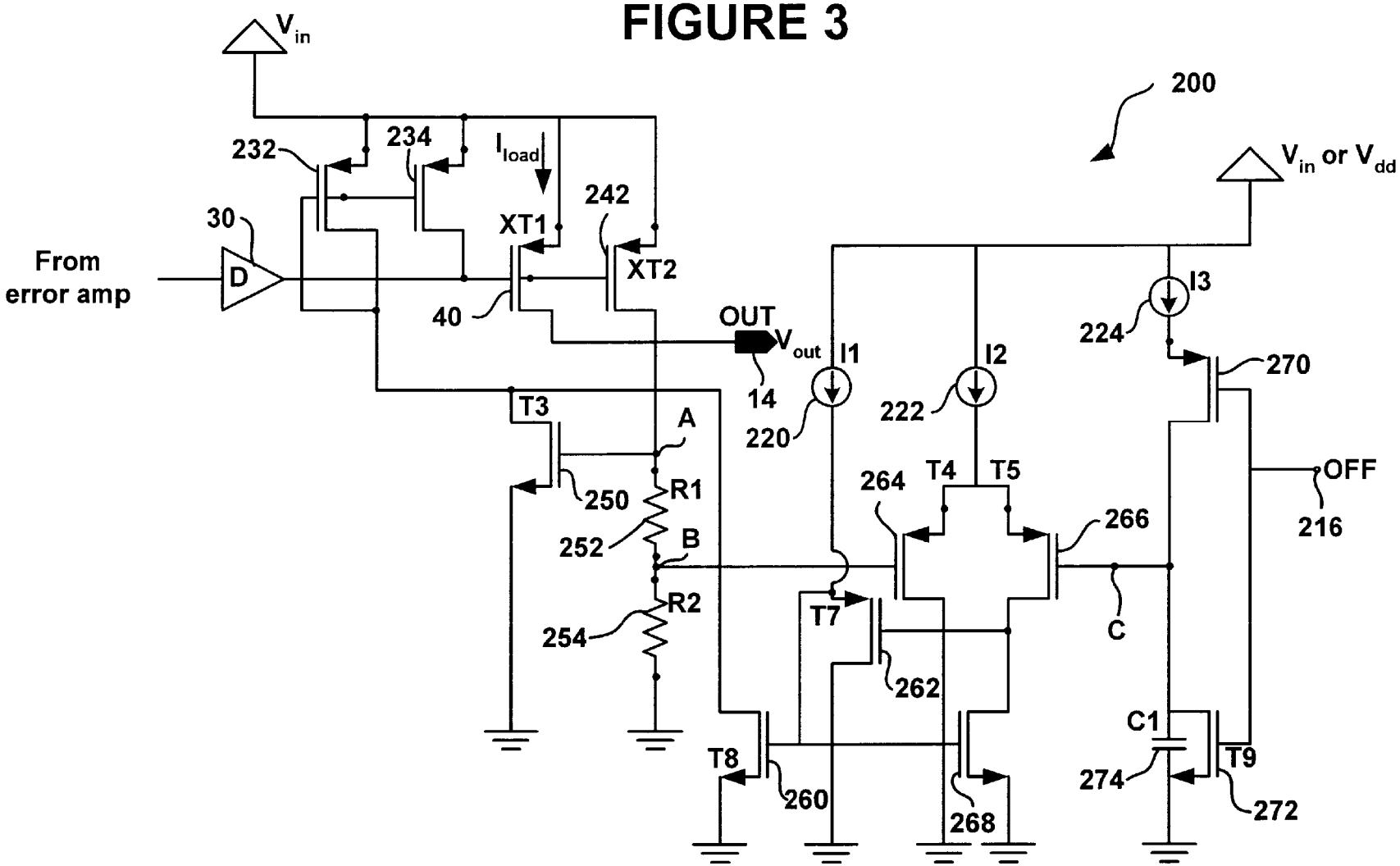
FIG. 3 is a graph of load current over time illustrating several examples of the function of the circuit of FIG. 2 in combination with the circuit of FIG. 1.

One of ordinary skill in the art will readily recognize that the functional blocks of control circuit 100 of FIG. 2 may be implemented in a variety of ways. FIG. 3 is a circuit diagram illustrating, at the circuit level, one circuit level embodiment of a current control circuit 200, according to the present invention, for controlling the in-rush current to a voltage regulator, such as the voltage regulator circuit of FIG. 1. In FIG. 3, amplifier/driver 30 is the pass transistor drive circuit for normal operation that corresponds to amplifier driver 30 shown in FIG. 1. Amplifier/driver 30 drives the gates of pass transistor 40 and a transistor 242, which is coupled in parallel with transistor 40. Transistors 232 and 234 are coupled between the input terminal 12 and the gates of transistors 40 and 242. The gates of transistors 232 and 234 are coupled together and to the drains of transistors 250 and 260.

The drain of transistor 40, a PMOS device, is coupled to output terminal 14. The drain of transistor 242, also a PMOS device, is coupled to node A, which is also coupled to the gate of transistor 250 and to resistor 252. Transistor 250 corresponds to amplifier 150 of FIG. 2, where the threshold voltage of transistor 250 is implicitly the predetermined threshold $V_{TH}$. Resistor 252 is coupled in series with resistor 254 and forms another circuit node B, which drives the gate of transistor 264, which corresponds to an input terminal of amplifier 160 of FIG. 2.

Transistors 270 and 272 are coupled in series between input terminal 12 and a ground terminal and are driven by an externally supplied signal OFF received at terminal 116. OFF is an inverted form of an ON signal provided from an external entity such as a microprocessor, e.g. a chip enable signal, or derived from the input voltage $V_{IN}$. When the circuit is enabled, then OFF goes to a low voltage that turns transistor 272 off and transistor 270 on in order to charge internal capacitor 274 from current source 224. When this occurs, the voltage $C_C$ at circuit node C begins to ramp up and drives the gate of transistor 266, which corresponds to another input terminal of amplifier 160 of FIG. 2.

Transistors 264 and 266, in combination with a low voltage current mirror formed by transistors 260, 262 and 268 along with current sources 220 and 222, form an amplifier. While current sources 220 and 222 are shown coupled to the input terminal 12 such that they operate from $V_{IN}$, they may also be coupled to a power supply rail and operate from a different power supply voltage, e.g. $V_{DD}$. The low voltage current mirror is formed because the drain of NMOS transistor 268 is coupled to the gate of PMOS transistor 262. The source of transistor 262, in turn, is coupled back to the gate of transistor 268. This causes the drain of transistor 268 to be at a lower voltage than the gate of transistor 268 allowing low voltage operation of the current mirror.

As noted above, transistor 242 is coupled in parallel to transistor 40. Consequently, the current through transistor 242 is proportional to the load current through PMOS pass transistor 40. Thus, transistor 242 is used to measure the output load current $I_{LOAD}$ through transistor 40. However, transistor 242 may be much smaller than transistor 40, e.g. transistor 40 may be thousands of times larger in width-to-length ratio than transistor 242. The current through transistor 242 generates a voltage $V_A$ at node A and is divided by resistors 252 and 254 to form a voltage $V_B$ at node B.

When the part is switched on, capacitor 274 is in discharged state and the gate of PMOS transistor 266 is at essentially 0 volts and the amplifier formed by transistors 260, 262, 264, 266, and 268 drives, through transistors 232 and 234, the gate of transistor 40 to $V_{dd}$, e.g. $V_{IN}$, causing the pass transistor 40 to switch off. As 13 provided by current source 224 charges capacitor 274, the gate of transistor 266 rises and the amplifier lets the amplifier/driver 30 switch on pass transistor 40 and sense transistor 242, until $V_B$ equals the voltage $C_C$ at the gate of transistor 266.

Since transistors 40 and 242 are basically a mirror, transistor 40 is now allowed to deliver $$\frac{V_B}{R_2} \times \frac{size40}{size142}$$

current to the load, where R2 is the resistance of resistor 254, size 40 is the width-to-length ratio of transistor 40, and size 142 is the width-to-length ratio of transistor 242. This current increases over time until a maximum limit is reached that is determined by the threshold voltage $V_{threshold}$ of transistor 250 being reached, e.g. when $V_A \sim V_{threshold}$.

Figure 4:
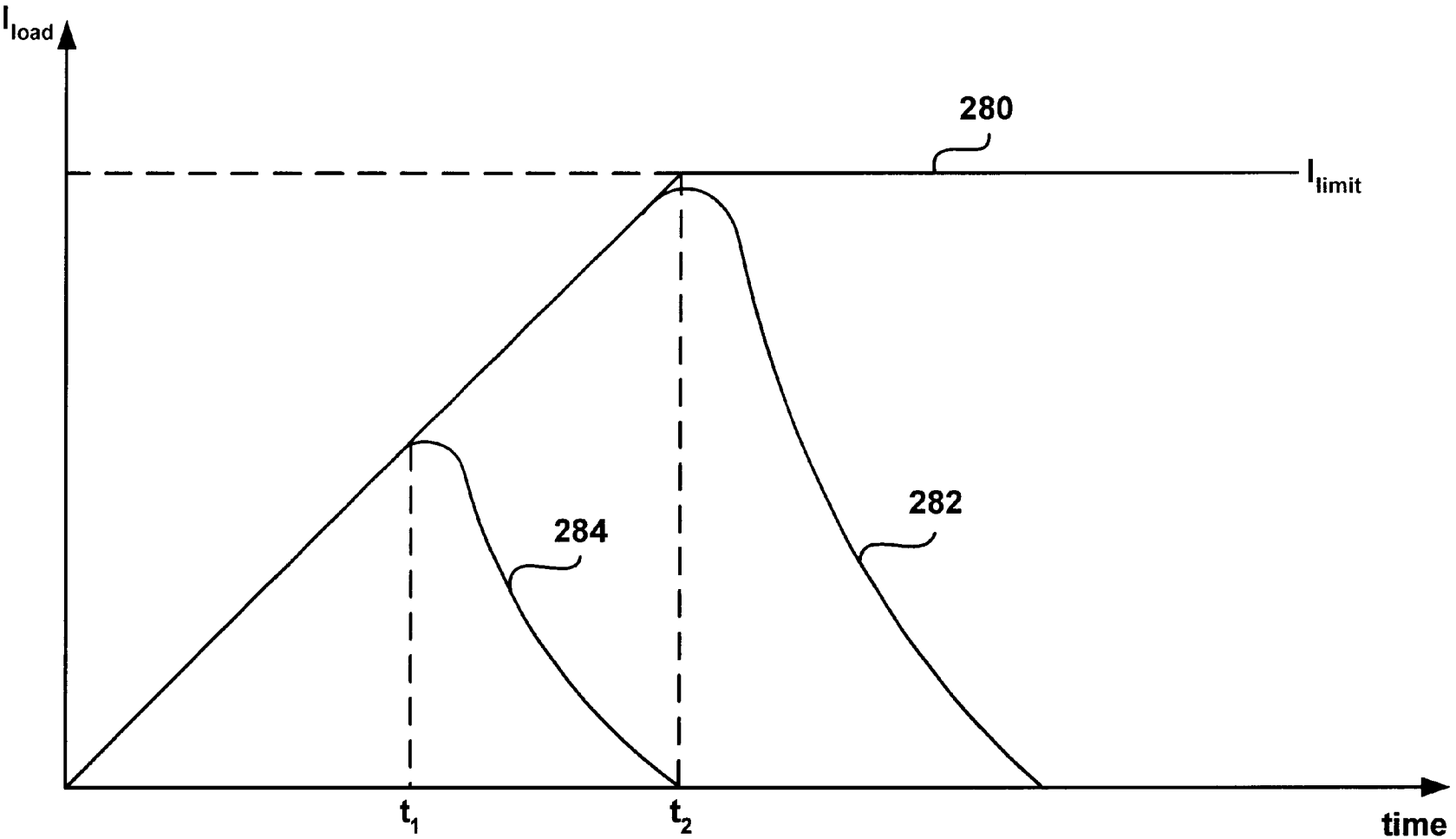
FIG. 4 is a circuit diagram illustrating another embodiment of the present invention for controlling an in-rush current of the voltage regulator circuit of FIG. 1.

FIG. 4 is a graph of load current $I_{LOAD}$ produced at output terminal 14 versus time to illustrate several examples of the function of the circuit of FIG. 3. If the output of the regulator has no load, then the output current of the regulator is basically used to charge only the output capacitor $C_{out}$. $C_{out}$ is necessary for stability of the low drop-out voltage regulator and its dominant frequency pole is proportional to $$\frac{gm}{C_{out}},$$

where gm is the transconductance of transistor 40 and is proportional to the load current $I_{LOAD}$.

In FIG. 4, the current curve 280 will increase until it reaches $I_{LIMIT}$, which is the current limit determined by the resistance R1 of resistor 252 in combination with resistance R2 of resistor 254 which produce $V_A$ at node A as current is conducted by sense transistor 242. When $V_A$ reaches the threshold voltage of NMOS transistor 250, then the transistor turns on and limits any further increase of in-rush current through transistor 40. This protects transistor 40 from damage due to excessive currents.

Further, in order to have an acceptable dominant pole frequency, the output capacitance $C_{out}$, e.g. the capacitor 48 in FIG. 1, may be chosen as a function of the load current for the particular voltage regulation application. In other words, selection of the the value of $C_{out}$, automatically adjusts the surge current of the control circuit according to the present invention. For example, a 1 $\mu$F output capacitor may be utilized for a 100 mA output current application, while a 0.1 $\mu$F output capacitor may be selected for a 10 mA output current load. In other words, the output capacitance $C_{out}$ is a function of the application and so is its charge time. Thus, a smaller output capacitor is charged faster and the load current maximum value is lower than for a bigger output capacitor.

Because of the linear ramping of $C_C$ in the current control circuit of the present invention, the operation of the circuit adapts to the output capacitance selected for the application. This is reflected in the curves 280, 282 and 284 illustrated in FIG. 4. When a smaller output capacitance is coupled to the output terminal 14, then the output capacitor will be charged sooner by the output current through pass transistor 40 and a curve similar to curve 284 occurs in the absence of a load current. When a larger output capacitance is coupled to the output terminal 14, then it takes longer to charge the output capacitor and a curve similar to curve 282 occurs in the absence of a load current. When an even larger output capacitance is utilized, then the output current will increase until the limit current is reached on the curve 280 and, in the absence of a load current, the current through pass transistor 40 will drop off.

When the output capacitor is chosen such that stability is obtained, then the maximum load current during start-up is essentially the same as the load current during operation and hence excessive voltage drops at the input may be avoided.

Also the size of the input capacitor $C_{IN}$ can be reduced, which results in lower cost, and stability of the error amplifier is guaranteed.

Note that, once the capacitance $C_1$ of internal capacitor 274 is charged, then control circuit 200 is prevented from activating and the regulator will be permitted to operate at its full current. Once $C_1$ becomes sufficiently charged, it effectively clamps the input of the amplifier to prevent it from further generating the in-rush current control signal to pass transistor 40. Thus, the control circuit according to the present invention, will control the in-rush current to a voltage regulator without impairing the peak operating current capability of the regulator.

Further note that each of the MOS transistors discussed above has a gate terminal, which may be viewed as a control terminal, as well as source and drain terminals, which may be viewed as current conducting terminals or current terminals. Other types of transistors have similar arrangements, such as a bipolar transistor that includes a base terminal as a control terminal and emitter and collector terminals that conduct current.

Having illustrated and described the principles of the present invention in the context of the embodiments described above, it should be readily apparent to those skilled in the art that the invention can be modified in arrangement and detail without departing from such principles.

I claim:

1. A control circuit for controlling an in-rush current of a voltage regulator circuit having a pass transistor, where the pass transistor has a control terminal, a first current terminal that is coupled to an input terminal of the regulator circuit, and a second current terminal coupled to an output terminal of the regulator circuit, the control circuit comprising:

a sense transistor having first and second current terminals and a control terminal, where the first current terminal of the sense transistor is coupled to the input terminal of the regulator circuit and the control terminal of the sense transistor is coupled to the control terminal of the pass transistor;

a ramp voltage generator circuit for generating a ramp voltage signal responsive to a control signal received at an input terminal of the ramp voltage generator circuit;

a first current source having first and second current terminals and a control terminal, the first current terminal of the first current source being coupled to the input terminal of the voltage regulator circuit and the second current terminal of the first current source being coupled to the control terminal of the pass transistor;

an amplifier having first and second input terminals and an output terminal, where the first input terminal of the amplifier is configured to receive a first voltage signal derived from the sense current, the second input terminal of the amplifier is configured to receive the ramp voltage signal, and the output terminal of the amplifier being coupled to the control terminal of the first current source.

2. The control circuit of claim 1, where the first current source further comprises a current mirror circuit configured to operate from a low power supply voltage.

3. The control circuit of claim 1, the control circuit further comprising a limiting circuit having first and second current terminals, first and second input terminals, and an output terminal, the first current terminal of the limiting circuit being coupled to the control terminal of the current source, the second current terminal of the limiting circuit being coupled to the power supply terminal, the first input terminal of the limiting circuit being configured to receive a second voltage signal derived from the sense current, the second input terminal of the limiting circuit being configured to receive a predetermined threshold voltage, and the output terminal of the limiting circuit being coupled to the control terminal of the first current source, where the limiting circuit is configured to compare the second voltage signal derived from the sense current to the predetermined threshold voltage and generate a current limiting signal at the output terminal of the limiting circuit.

4. The control circuit of claim 3, the control circuit further comprising a divider circuit coupled between the second current terminal of the sense transistor and a power supply terminal, the voltage divider having a first circuit node and a second circuit node coupled to the sense transistor, where the voltage divider is configured to generate the first voltage signal derived from the sense current at the first circuit node and generate the second voltage signal derived from the sense current at the second circuit node.

5. The control circuit of claim 4, where the limiting circuit further comprises a transistor having first and second current terminals and a control terminal, where the control terminal of the transistor is coupled to the second circuit node, the first current terminal is coupled to the control terminal of the first current source, and the second current terminal is coupled to the power supply terminal.

6. The control circuit of claim 1, where the ramp voltage generator circuit further comprises:

a first transistor having first and second current terminals and a control terminal, where the control terminal of the first transistor is coupled to the input terminal of the ramp voltage generator circuit;

a second current source coupled between another power supply terminal and the first current terminal of the first transistor;

a capacitor coupled between the power supply terminal and the second current terminal of the first transistor; and a second transistor having first and second current terminals and a control terminal, where the control terminal of the second transistor is coupled to the input terminal of the ramp voltage generator circuit, the first current terminal of the second transistor is coupled to the second current terminal of the first transistor, and the second current terminal of the second transistor is coupled to the power supply terminal, where the first and second transistors are configured to have a complementary response to the control signal such that the ramping voltage signal is generated at the first current terminal of the second transistor responsive to a control signal received at the input terminal of the ramp voltage generator circuit.

7. The control circuit of claim 6, where the another power supply terminal further comprises the input terminal of the voltage regulator circuit.

8. The control circuit of claim 1, where the first current source further comprises:

a third transistor having first and second current terminals and a control terminal, where the first current terminal of the third transistor is coupled to the first current terminal of the first current source, and where the control terminal of the third transistor and the second current terminal of the third transistor are coupled to the control terminal of the first current source; and a fourth transistor having first and second current terminals and a control terminal, where the first current terminal of the fourth transistor is coupled to the first current terminal of the first current source, and where the control terminal of the fourth transistor is coupled to the control terminal of the first current source, and the second current terminal of the fourth transistor is coupled to the second current terminal of the first current source.

9. The control circuit of claim 1, where the amplifier further comprises:

a second current source configured to provide a first predetermined current;

a fifth transistor having first and second current terminals and a control terminal, where the first current terminal of the fifth transistor is coupled to the second current source and the control terminal of the fifth transistor is coupled to the first input terminal of the arnplifier;

a sixth transistor having first and second current terminals and a control terminal, where the first current terminal of the fifth transistor is coupled to the second current source and the control terminal of the fifth transistor is coupled to the second input terminal of the amplifier;

a third current source configured to provide a second predetermined current;

a seventh transistor having first and second current terminals and a control terminal, where the first current terminal of the seventh transistor is coupled to the third current source, the second current terminal of the seventh transistor is coupled to the power supply terminal, and the control terminal of the seventh transistor is coupled to the second current terminal of the fifth transistor;

an eighth transistor having first and second current terminals and a control terminal, where the first current terminal of the eighth transistor is coupled to the second current terminal of the fifth transistor, the second current terminal of the eighth transistor is coupled to the power supply terminal, and the control terminal of the eighth transistor is coupled to the first current terminal of the seventh transistor; and a ninth transistor having first and second current terminals and a control terminal, where the first current terminal of the ninth transistor is coupled to the control terminal of the first current source, the second current terminal of the ninth transistor is coupled to the power supply terminal, and the control terminal of the ninth transistor is coupled to the control terminal of the eighth transistor.

10. The control circuit of claim 9, where the second and third current sources source current from one of another power supply terminal and the input terminal of the voltage regulator circuit.

11. A current control device for controlling an in-rush current through a pass transistor of a voltage regulator circuit, where the pass transistor has a control terminal and a first current terminal that are coupled to an input terminal of the regulator circuit and a second current terminal coupled to an output terminal of the regulator circuit, the current control device comprising:

current sensing means having first and second current terminals and a control terminal, where the first current terminal of the current sensing means is coupled to the input terminal of the regulator circuit and the control terminal of the current sensing means is coupled to the control terminal of the pass transistor;

ramp voltage generating means for generating a ramping voltage signal responsive to a control signal received at an input terminal of the ramp voltage generating means;

a first current source having first and second current terminals and a control terminal, the first current terminal of the first current source being coupled to the input terminal of the voltage regulator circuit and the second current terminal of the first current source being coupled to the control terminal of the pass transistor; and amplifier means having first and second input terminals and an output terminal, the first input terminal of the amplifier means being configured to receive a first voltage signal derived from the sense current, the second input terminal of the amplifier means being configured to receive the ramping voltage signal, and the output terminal of the amplifier means being coupled to the control terminal of the first current source.

12. The current control device of claim 11, where the first current source further comprises a current mirror.

13. The current control device of claim 11, the current control device further comprising current limiting means having first and second current terminals, first and second input terminals, and an output terminal, the first current terminal of the current limiting means being coupled to the control terminal of the first current source, the second current terminal of the current limiting means being coupled to the power supply terminal, the first input terminal of the current limiting means being configured to receive a second voltage signal derived from the sense current, the second input terminal of the current limiting means being configured to receive a predetermined threshold voltage, and the output terminal of the current limiting means being coupled to the control terminal of the first current source, where the current limiting means is configured to compare the second voltage signal derived from the sense current to the predetermined threshold voltage and generate a current limiting signal at the output terminal of the current limiting means.

14. The current control device of claim 13, where the current control device further includes sense current conversion means for converting the sense current to the first voltage signal derived from the sense current and the second voltage signal derived from the sense current.

15. A method for controlling an in-rush current through a pass transistor of a voltage regulator circuit, the method comprising the steps of:

providing a sense transistor that mirrors the pass transistor;

converting a sense current of the sense transistor into a first voltage signal;

generating a ramp voltage signal responsive to a control signal;

comparing the first voltage signal to the ramp voltage signal to generate an in-rush current control signal; and sourcing current to control terminals of the sense transistor and the pass transistor under control of the in-rush current control signal.

16. The method of claim 15, where the step of converting a sense current of the sense transistor into a first voltage signal includes converting the sense current of the sense transistor into a second voltage signal and the method further includes the step of limiting the in-rush current control signal when the second voltage signal reaches a predetermined threshold.

17. The method of claim 15, where the step of sourcing current to control terminals of the sense transistor and the pass transistor under control of the in-rush current control signal further comprises:

driving a first transistor with the in-rush current control signal;

mirroring a current in the first transistor with a current in a second transistor; and sourcing current to the control terminals of the sense transistor and the pass transistor with the second transistor.

* * * * *